US012402683B2

(12) United States Patent
Sang et al.

(10) Patent No.: US 12,402,683 B2
(45) Date of Patent: Sep. 2, 2025

(54) HELMET

(71) Applicant: HJC CORP., Yongin-si (KR)

(72) Inventors: Man Gyu Sang, Gwangmyeong-si (KR); Hyoung Wook Im, Seoul (KR)

(73) Assignee: HJC CORP., Yongin-si (KR)

( * ) Notice: Subject to any disclaimer, the term of this patent is extended or adjusted under 35 U.S.C. 154(b) by 34 days.

(21) Appl. No.: 18/285,710

(22) PCT Filed: Apr. 6, 2022

(86) PCT No.: PCT/KR2022/004942
§ 371 (c)(1),
(2) Date: Oct. 5, 2023

(87) PCT Pub. No.: WO2022/216037
PCT Pub. Date: Oct. 13, 2022

(65) Prior Publication Data

US 2024/0188671 A1 Jun. 13, 2024

(30) Foreign Application Priority Data

Apr. 7, 2021 (KR) ..... 10-2021-0045327

(51) Int. Cl.
*A42B 3/32* (2006.01)
*A42B 3/12* (2006.01)

(52) U.S. Cl.
CPC ..... *A42B 3/328* (2013.01); *A42B 3/127* (2013.01)

(58) Field of Classification Search
CPC ..... A42B 3/328; A42B 3/127; A42B 3/32; A42B 3/00
See application file for complete search history.

(56) References Cited

U.S. PATENT DOCUMENTS 6,256,797 B1 * 7/2001 Nemoto ..... A42B 3/328 2/424
6,370,699 B1 4/2002 Halstead et al.
(Continued)

FOREIGN PATENT DOCUMENTS

EP 1084641 A2 3/2001
JP 2009041126 A 2/2009
(Continued)

OTHER PUBLICATIONS

International Search Report (English and Korean) and Written Opinion of the ISA (Korean) issued in PCT/KR2022/004942, mailed Jul. 26, 2022; ISA/KR.
(Continued)

*Primary Examiner* — Uyen T Nguyen
(74) *Attorney, Agent, or Firm* — Harness, Dickey & Pierce, P.L.C.

(57) ABSTRACT

The helmet according to an embodiment of the present invention includes a helmet body; a pad coupled to the inside of the helmet body, and a coupling member that separably couples the helmet body and the pad, wherein the coupling member may include a male coupling member disposed in one of either the inside of the helmet body or the pad, and a female coupling member disposed in the other of either the inside of the helmet body or the pad and into which the male coupling member is inserted and fixed, wherein the male coupling member has a first inclined surface at a portion inserted and fixed into the female coupling member, and the female coupling member has a second inclined surface corresponding to the first inclined surface, and when an external force is applied to the pad in a first direction so that the male coupling member is separated from the female coupling member in a state in which the male coupling member and the female coupling member are coupled, the
(Continued)

first inclined surface moves along the second inclined surface, and the pad is separated from the helmet body.

10 Claims, 10 Drawing Sheets

(56) References Cited

U.S. PATENT DOCUMENTS

| | | | | |
|---|---|---|---|---|
| 6,401,308 | B1 | 6/2002 | Kawahara | |
| 8,800,065 | B2 | 8/2014 | Ikeda | |
| 2007/0271688 | A1* | 11/2007 | Ando | A42B 3/127 2/410 |
| 2009/0038054 | A1* | 2/2009 | Ikeda | A42B 3/328 2/414 |
| 2010/0095437 | A1* | 4/2010 | Ikeda | A42B 3/127 2/424 |
| 2020/0138142 | A1* | 5/2020 | Kim | A42B 3/328 |
| 2020/0163401 | A1 | 5/2020 | Lee | |

FOREIGN PATENT DOCUMENTS

| | | | |
|---|---|---|---|
| KR | 100674787 | B1 | 1/2007 |
| KR | 1020170063030 | A | 6/2017 |
| KR | 1020190008802 | A | 1/2019 |
| KR | 101995947 | B1 | 7/2019 |

OTHER PUBLICATIONS

Extended European Search Report for Application No. 22784946.0 dated Mar. 12, 2025 (8 pages).

* cited by examiner

HELMET

CROSS-REFERENCE TO RELATED APPLICATIONS

This application is a U.S. National Phase Application under 35 U.S.C. 371 of International Application No. PCT/KR2022/004942, filed on Apr. 6, 2022, which claims priority to and the benefit of Korean Patent Application No. 10-2021-0045327, filed on Apr. 7, 2021, the disclosures of which are incorporated herein by reference in their entirety.

FIELD

The present invention relates to a helmet, and more particularly, to a helmet capable of removing a pad coupled to the inside of the helmet in emergency situations.

BACKGROUND

In the case of a two-wheeled vehicle, there is a very high risk that the shock will be transmitted to a rider in the event of an accident. Accordingly, it is essential for the rider of the two-wheeled vehicle to wear a riding safety helmet, that is, a helmet, to protect his head.

In general, the helmet includes an outer shell that primarily protects the wearer's head from external impact, and a pad that is coupled to the inside of the outer shell. In this way, the pad provided inside the outer shell is in close contact with the head of the wearer to provide a sense of wearing stability and prevent the helmet from being easily peeled off when wearing the helmet.

Meanwhile, when an accident occurs and rescue is required for the wearer, the helmet must be removed from the wearer's head. However, it is difficult to separate the helmet due to the pad closely attached to the wearer's head and secondary injuries occur in the wearer's neck during the process of forcibly separating the helmet.

Therefore, there is a need to develop a helmet that can easily remove the pad in an emergency so that the pad can be stably fixed inside the helmet to provide a comfortable fit while easily separating the helmet from the wearer's head in the event of an accident.

(Priority Document) Patent No. 1995947, "Helmet being capable of removing pad in case of emergency" issued by the Korean Intellectual Property Office on Jul. 3, 2019.

SUMMARY

The present invention is to solve the problems of the prior art. The purpose of the present invention is to provide a helmet that is easily separated from the wearer's head in an emergency because the pad that is coupled to the inside and disposed between the outer shell and the wearer's head can be effectively removed by a force having a specific direction.

According to an aspect of the present invention, there is provided a helmet including a helmet body; a pad coupled to the inside of the helmet body; and a coupling member that separably couples the helmet body and the pad, wherein the coupling member may include a male coupling member disposed in one of either the inside of the helmet body or the pad, and a female coupling member disposed in the other of either the inside of the helmet body or the pad and into which the male coupling member is inserted and fixed, wherein the male coupling member has a first inclined surface at a portion inserted and fixed into the female coupling member, and the female coupling member has a second inclined surface corresponding to the first inclined surface, and when an external force is applied to the pad in a first direction so that the male coupling member is separated from the female coupling member in a state in which the male coupling member and the female coupling member are coupled, the first inclined surface moves along the second inclined surface, and the pad is separated from the helmet body.

In this case, the male coupling member may include a base portion fixed to either the inside of the helmet body or the pad; an extension portion that protrudes and extends from one side of the base portion and has the first inclined surface on one side thereof; and an expansion end portion provided at an end of the extension portion in an extension direction, at least a portion thereof extending outward than the extension portion in a direction perpendicular to the extension direction.

In addition, a portion of the extension portion having the first inclined surface may protrude outward than the expansion end portion in a direction perpendicular to the extension direction.

In addition, the helmet may further include a cover plate disposed to cover one surface of either the inside of the helmet body or the pad, and fixing the base portion.

In addition, the cover plate may have a through hole formed in a size that does not pass through the base portion, and wherein the base portion is disposed inside the helmet body or between the pad and the cover plate, and the extension portion extends through the through hole.

In addition, the extension portion may include a first extension portion extending through the through hole, and a second extension portion disposed between the first extension portion and the expansion end portion and having the first inclined surface on one side thereof.

In addition, the helmet may further include a movement prevention member may include a fixing portion fixed to the cover plate, and a movement prevention portion connected to the fixing portion to prevent the movement of the male coupling member by being fastened to the extension portion.

In addition, the second extension portion may include a fastening portion to which the movement prevention member is coupled, and the movement prevention portion is coupled to the fastening portion.

In addition, the female coupling member may further include a body having a receiving space to receive at least a portion of the extension portion and the expansion end portion and having the second inclined surface on one side of the inner wall of the receiving space, and an opening formed in the body in communication with the receiving space.

In addition, the opening may include a first portion provided in a shape surrounding the extension and a second portion connected to the first part and provided in a shape of a slot exposing the second inclined surface.

In addition, the second inclined surface and the second portion may be formed to be wider than the expansion end portion.

In addition, the helmet further includes a pulling portion provided to the pad to be pulled by the external force in the first direction, and wherein the first inclined surface and the second inclined surface may be oriented toward the pulling portion or a virtual point extending in the first direction.

According to the present invention, when an external force is applied in a specific direction according to the interaction between the first inclined surface and the second inclined surface, the pad is easily separated from the inside of the helmet body, thereby making it possible to safely separate the helmet from the wearer's head in an emergency.

DETAILED DESCRIPTION

Figure 1:
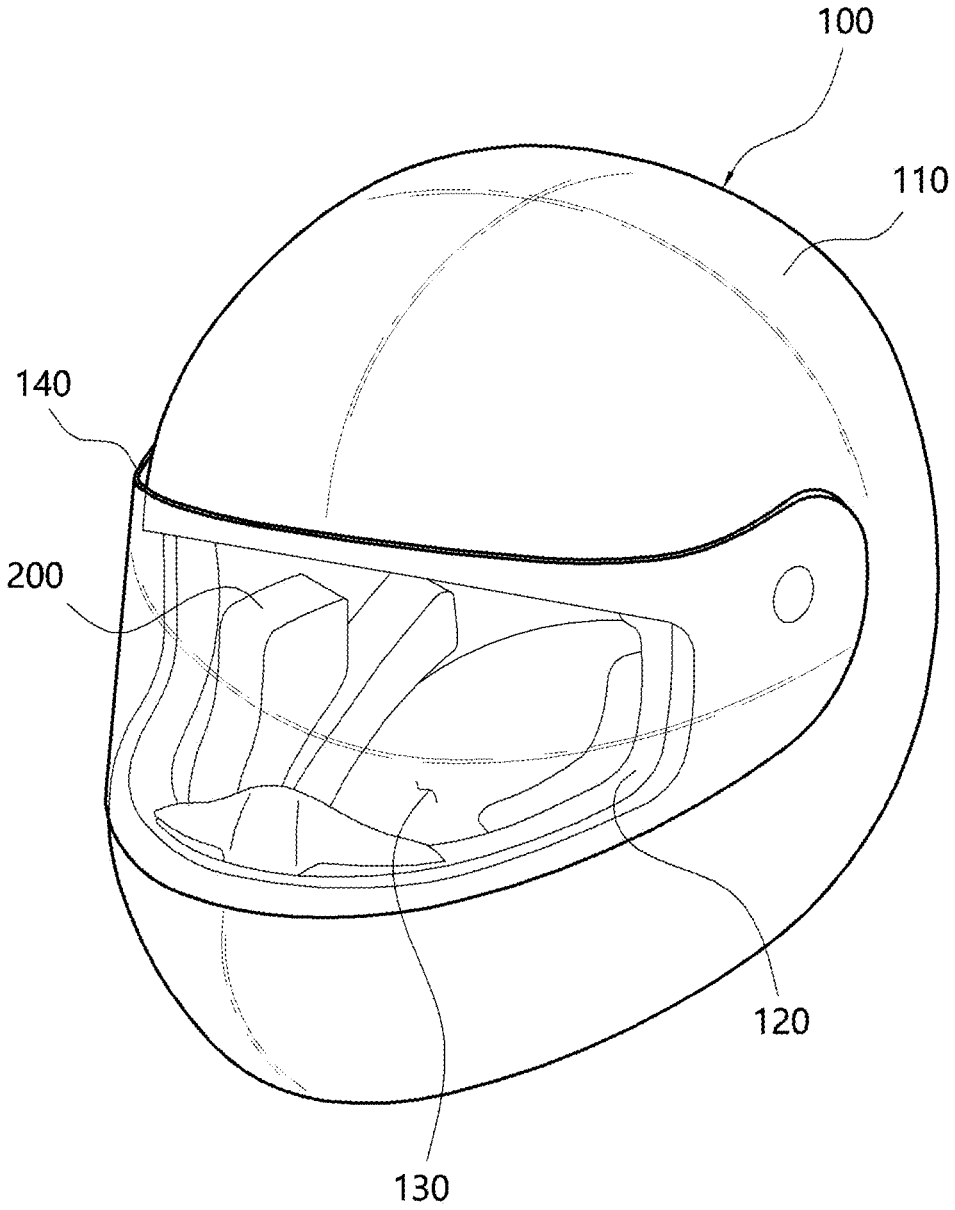
FIG. 1 is a perspective view of a helmet according to an embodiment of the present invention.

Hereinafter, embodiments of the present disclosure will be described in detail so that those skilled in the art to which the present disclosure pertains can easily carry out the embodiments. The present disclosure may be implemented in many different forms and is not limited to the embodiments described herein. In order to clearly describe the present disclosure, portions not related to the description are omitted from the accompanying drawings, and the same or similar components are denoted by the same reference numerals throughout the specification.

In the specification, it should be understood that the terms such as "comprise" or "have" are intended to specify the presence of features, numbers, steps, operations, components, parts, or combinations thereof described in the specification and do not preclude the possibility of the presence or addition of one or more other features, numbers, steps, operations, components, parts, or combinations thereof.

In this specification, "front", "rear". "upper", or "lower" and the like, which are spatially relative terms, may be used to describe the correlation with the components illustrated in the drawings. These are relative terms determined based on the figures and the positional relationship may be interpreted as opposite depending on the orientation. In addition, the fact that a component is "connected" to another component includes not only directly connected to each other but also indirectly connected to each other unless otherwise specified.

FIG. 1 is a perspective view of a helmet according to an embodiment of the present invention. In addition, FIG. 2 is an exploded perspective view of a helmet according to an embodiment of the present invention.

Figure 2:
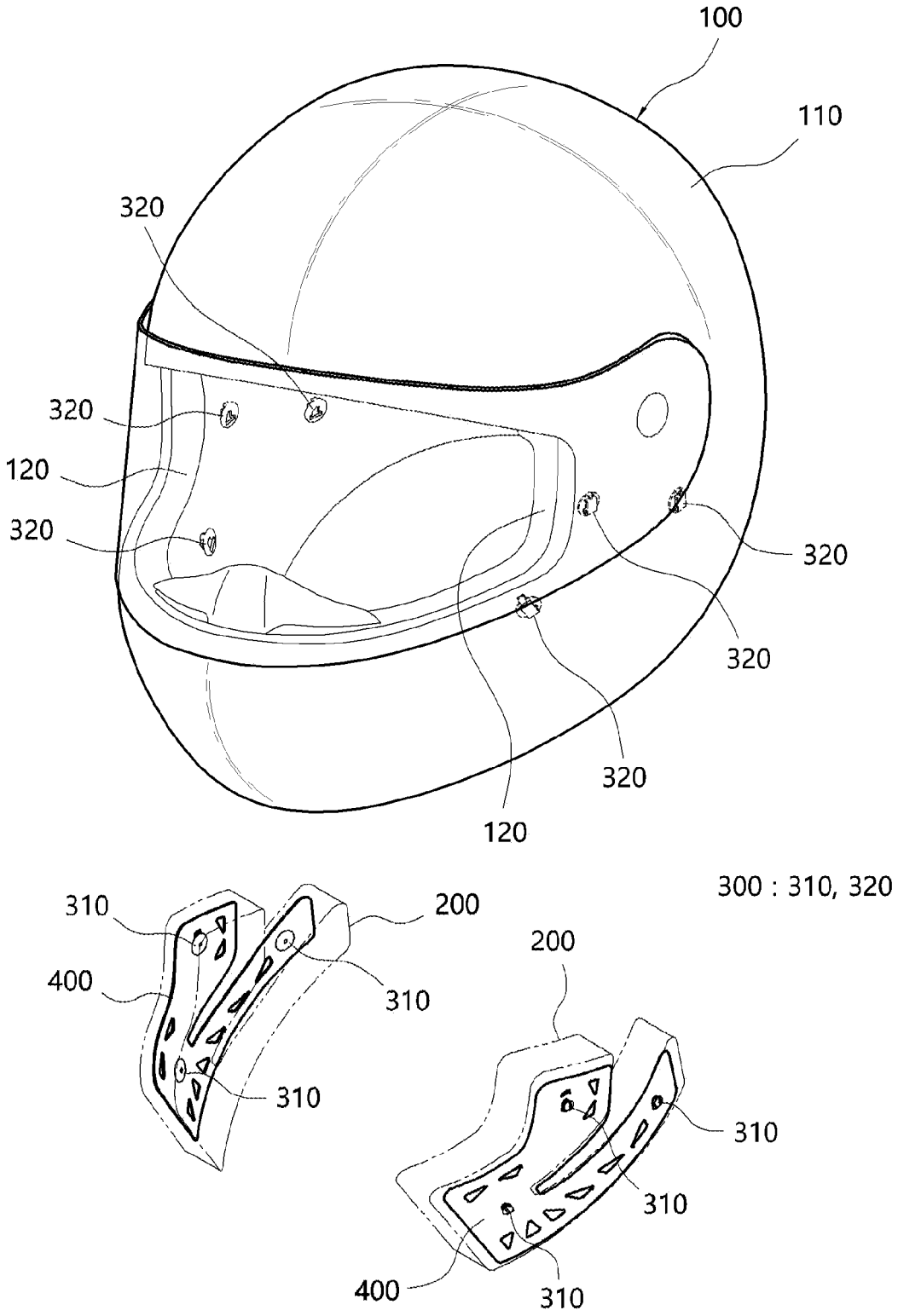
FIG. 2 is an exploded perspective view of a helmet according to an embodiment of the present invention.

Referring to FIGS. 1 and 2, the helmet according to an embodiment of the present invention includes a helmet body 100, a pad 200 coupled to the inside of the helmet body 100, and a coupling member 300 that separably couples the helmet body 100 and the pad 200.

The helmet body 100 serves to protect the head of the wearer. The helmet body 100 may be made of a material capable of absorbing impact. For example, the helmet body 100 may include an outer shell 110 that is made of a hard synthetic resin or the like and has high strength, and a shock absorber 120 provided inside the outer shell 110. In this case, the shock absorber 120 may be made of expanded polystyrene (EPS) or the like.

In an embodiment of the present invention, the pad 200 may be coupled to the inner wall of the shock absorber 120 by the coupling member 300. However, the helmet body 100 does not necessarily include the shock absorber 120, the pad 200 does not also have to be coupled to the inner wall of the shock absorber 120, and may be coupled to any other portion of the interior of the helmet body 100.

The helmet body 100 may have an opening 130 opened in front thereof to secure the user's view. In addition, the opening 130 may be opened and closed by the shield 140 rotatably coupled to the helmet body 100.

The pad 200 is disposed between the inside of the helmet body 100 and the wearer's head to provide a stable fit to the wearer. In an embodiment of the present invention, the pad 200 may be detachable coupled to the inside of the helmet body 100 (for example, the inner wall of the shock absorber 120) by the coupling member 300. The pad 200 coupled to the inside of the helmet body 100 may be in contact with the jaw, cheeks, ears, etc. of the helmet wearer.

The pad 200 may be formed to have elasticity to perform a buffering action between the wearer's head and the helmet body 100 and to be deformed according to the shape of the wearer's head. In addition, the cover plate 400 may be disposed to cover one surface of either the inside of the helmet body 100 or the pad 200. In an embodiment of the present invention, a cover plate 400 is disposed on one surface (a surface in contact with the helmet body 100) of the pad 200. That is, the cover plate 400 may cover one surface of the pad 200 and be disposed between the inner surface of the helmet body 100 and one surface of the pad 200.

The coupling member 300 includes a male coupling member 310 disposed in one of either the inside of the helmet body 100 or the pad 200, and a female coupling member 320 disposed in the other of either the inside of the helmet body 100 or the pad 200 and into which the male coupling member 310 is inserted and fixed.

Figure 3:
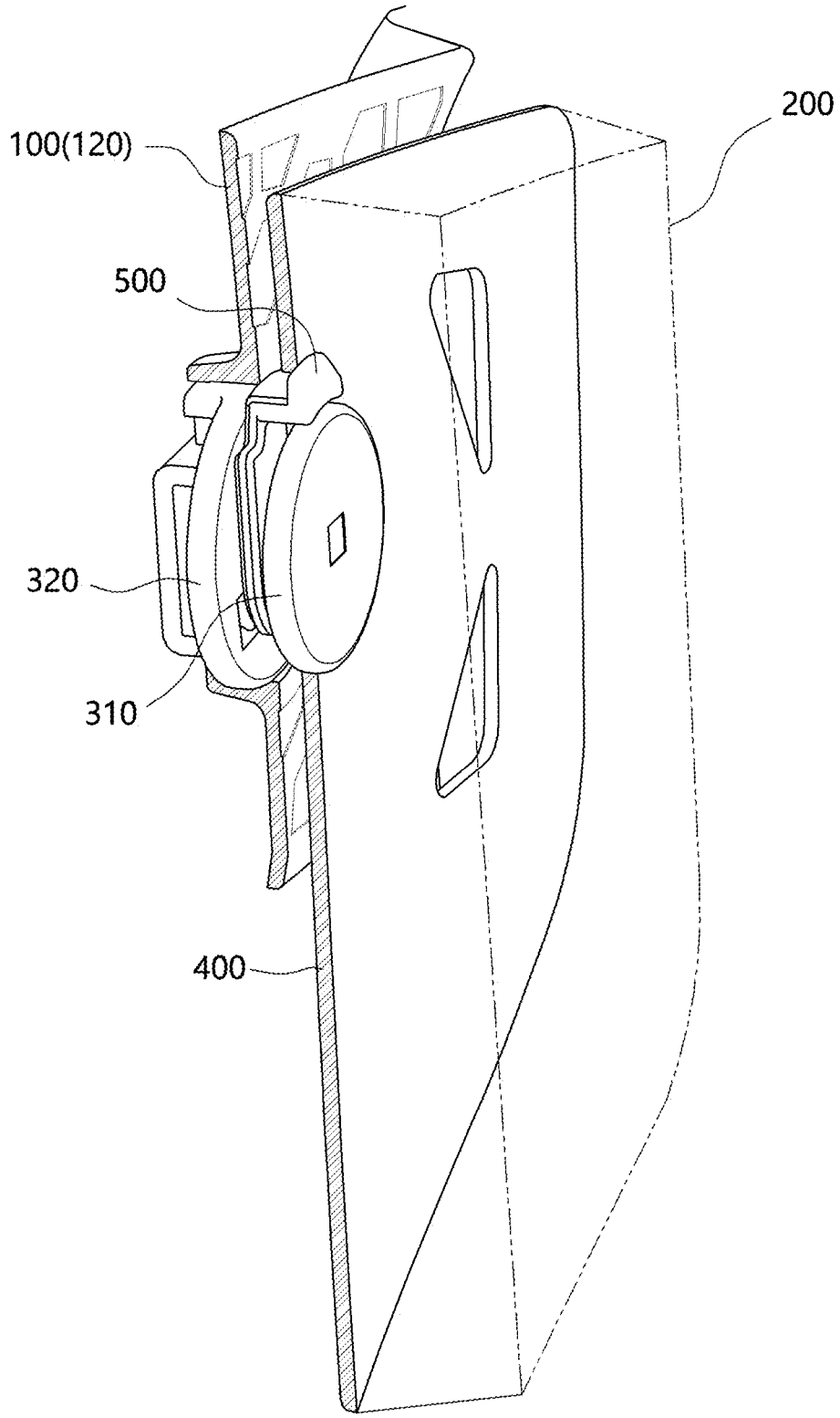
FIG. 3 is a view showing the fastening state between a helmet body and a pad in a helmet according to an embodiment of the present invention.
Figure 4:
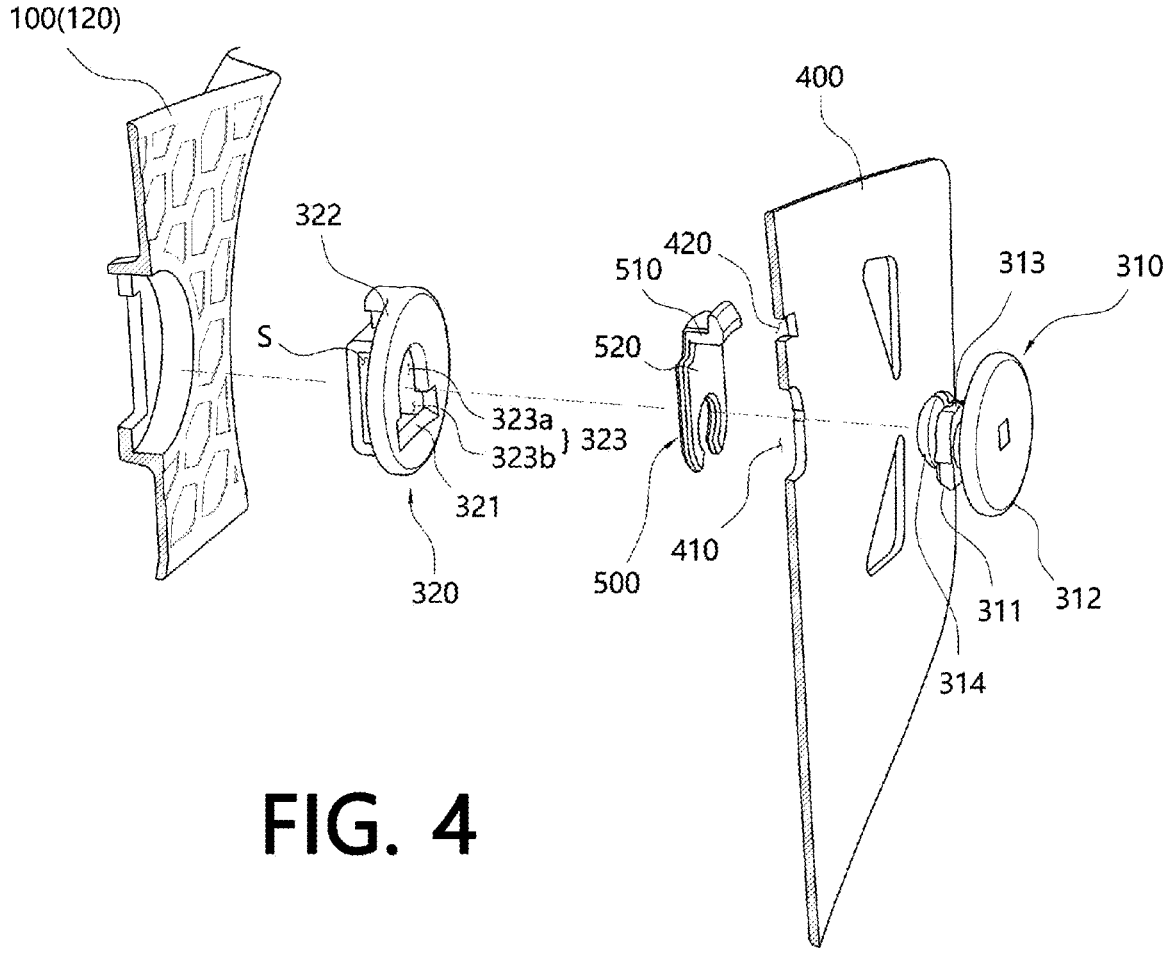
FIG. 4 is an exploded view of FIG. 3.
Figure 5:
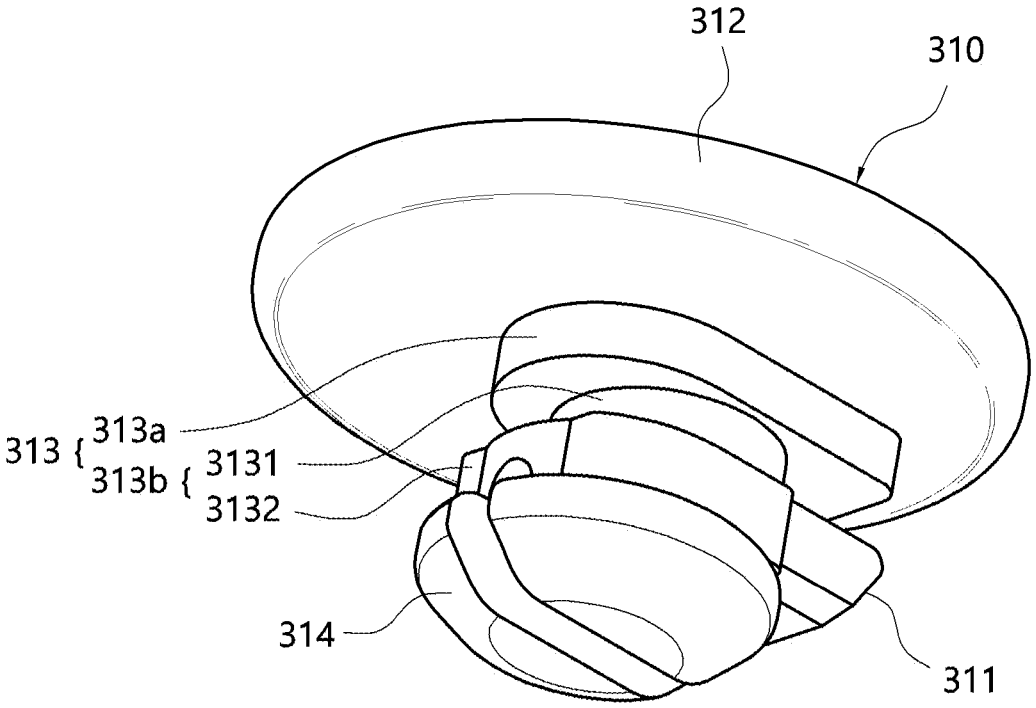
FIG. 5 is a perspective view of a male coupling member of a coupling member of a helmet according to an embodiment of the present invention.
Figure 6:
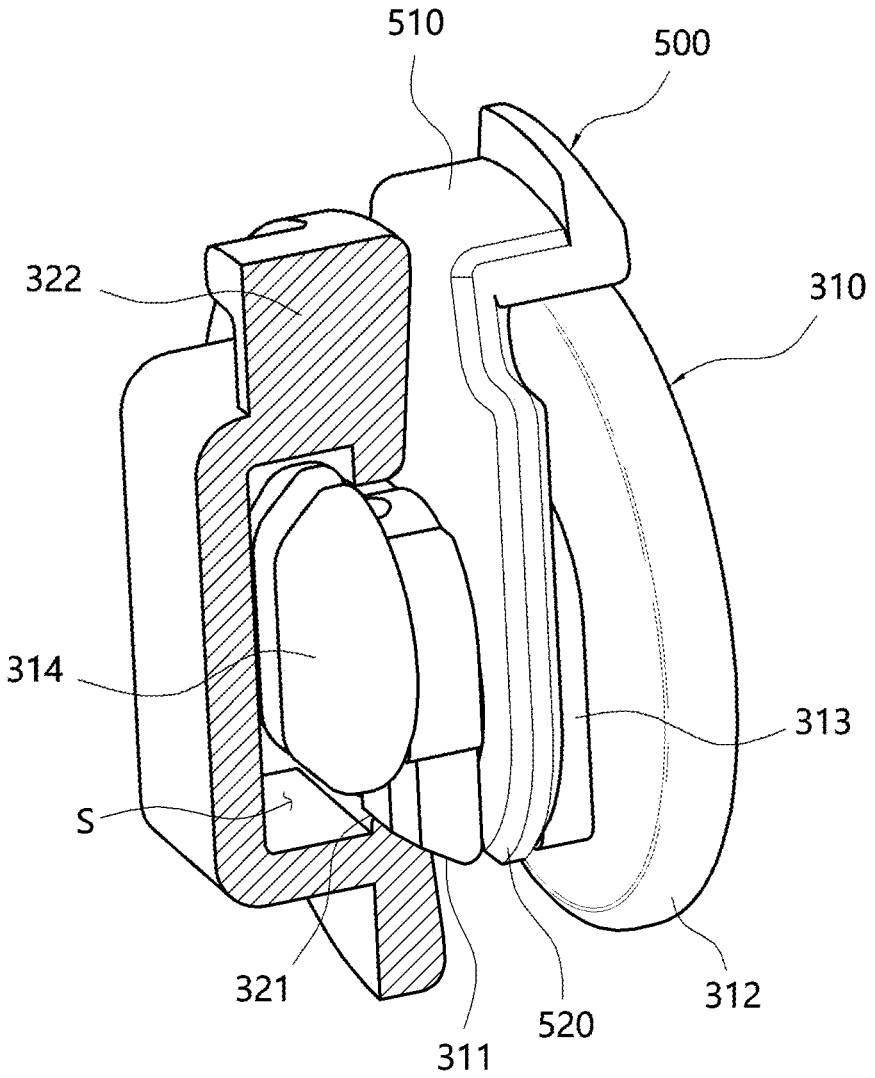
FIG. 6 is a view showing a fastening state between a male coupling member and a female coupling member of a coupling member of a helmet according to an embodiment of the present invention.

FIG. 3 is a view showing the fastening state between a helmet body and a pad in a helmet according to an embodiment of the present invention, and FIG. 4 is an exploded view of FIG. 3. In addition, FIG. 5 is a perspective view of a male coupling member of a coupling member of a helmet according to an embodiment of the present invention, and FIG. 6 is a view showing a fastening state between a male coupling member and a female coupling member of a coupling member of a helmet according to an embodiment of the present invention. In FIG. 6, illustrations of the helmet body 100, the pad 200, and the cover plate 400 are omitted.

Referring to FIGS. 3 to 6. The male coupling member 310 has a first inclined surface 311 at a portion inserted and fixed into the female coupling member 320, and the female coupling member 320 has a second inclined surface 321 corresponding to the first inclined surface 311. When an external force is applied to the pad 200 in a first direction so that the male coupling member 310 is separated from the female coupling member 320 in a state in which the male coupling member 310 and the female coupling member 320 are coupled, the first inclined surface 311 moves along the second inclined surface 321 to release the coupling of the male coupling member 310 and the female coupling member 320, thereby easily separating the pad 200 from the helmet body 100.

The male coupling member 310 may include a base portion 312 fixed to either the inside of the helmet body 100 or the pad 200, an extension portion 313 that protrudes and extends from one side of the base portion 312 and has a first inclined surface 311 on one side thereof, and an expansion end portion 314 provided at an end of the extension portion 313 in an extension direction, at least a portion thereof extending outward than the extension portion 313 in a direction perpendicular to the extension direction.

In an embodiment of the present invention, the base portion 312 is fixed to the pad 200 side by the cover plate 400. For example, the base portion 312 may be made of a plate, the cover plate 400 may include a through hole 410 formed in a size that does not pass through the base portion 312 and the base portion 312 may be disposed between the pad 200 and the cover plate 400. Meanwhile, according to another embodiment in which the male coupling member 310 is provided on the side of the helmet body 100, the base portion 312 may be fixed inside the helmet body 100.

The extension portion 313 may extend through the through hole 410 (see FIGS. 3 and 4). More specifically, the extension portion 313 may include a first extension portion 313*a* extending through the through hole 410 and a second extension portion 313*b* disposed between the first extension portion 313*a* and the expansion end portion 314 and having a first inclined surface 311 on one side thereof.

The first extension portion 313*a* may have a shape corresponding to the shape of the through hole 410 and may be extended from one surface of the base portion 312. If the first extension portion 313*a* and the through hole 410 have a corresponding shape, it may be helpful for the male coupling member 310 to be stably fixed to the cover plate 400.

The second extension portion 313*b* may include a fastening portion 3131 to which the movement prevention member 500 is coupled and an additional extension portion 3132 which is additionally extended from the fastening portion 3131 in the extension direction and has the first inclined surface 311 on one side thereof. In this case, the first inclined surface 311 may be formed to be inclined inward from the outside in a direction perpendicular to the extending direction along the extending direction of the extension portion 313. In addition, the coupling portion 3131 of the second extension portion 313*b* is formed to have a cross-sectional area smaller than that of the first extension portion 313*a* and the additional extension portion 3132 of the second extension portion 313*b*, so the movement of the movement prevention member 500 may be restricted in the extension direction by the first extension portion 313*a* and the additional extension portion 3132 in a state in which the movement prevention member 500 is coupled to the fastening portion 3131.

In an embodiment of the present invention, the male coupling member 310 is fixed to the pad 200 side, and since the pad 200 has elasticity, the male coupling member 310 may be pressed toward the pad 200 side and may move when the male coupling member 310 and the female coupling member 320 are intended to be coupled. Accordingly, smooth coupling between the male coupling member 310 and the female coupling member 320 may be hindered. The movement prevention member 500 is disposed to prevent the movement of the male coupling member 310.

The movement prevention member 500 may include a fixing portion 510 fixed to the cover plate 400 and a movement prevention portion 520 connected to the fixing portion 510 to prevent the movement of the male coupling member 310 by being fastened to the extension portion 313. More specifically, the fixing part 510 may be formed of a hook fastened to the hook hole 420 formed in the cover plate 400, and the movement prevention portion 520 may be formed of a C-ring which is fastened while surrounding the fastening portion 3131.

Of course, the configuration of the movement prevention member 500 is not limited by this, and the fastening structure between the fixing portion 510, the movement prevention portion 520, and the fastening portion 3131 fixed to the cover plate 400 can be modified in various forms. For example, the movement prevention portion 520 may be made of a male fastening portion, and the fastening portion 3131 may be made of a female fastening portion.

The expansion end portion 314 is fixed in a receiving space S of the female coupling member 320 while the male coupling member 310 is fastened to the female coupling member 320. The expansion end portion 314 may have a shape that interferes with the opening 323 of the female coupling member 320 when force is not applied in the first direction and is applied in the other direction so that separation between the male coupling member 310 and the female coupling member 320 can be made only through a path through which the first inclined surface 311 of the male coupling member 310 moves along the second inclined surface 321 of the female coupling member 320.

The expansion end portion 314 may have a shape that allows its cross-sectional area to be modified by elasticity. Accordingly, when the expansion end portion 314 passes through the opening 323 of the female coupling member 320, the cross-sectional area thereof is reduced and deformed by elasticity to enter the receiving space S, and the state in which the cross-sectional area thereof is expanded in the receiving space S may be recovered.

Meanwhile, in an embodiment of the present invention, a portion of the extension portion 313 having the first inclined surface 311 may protrude outward than the expansion end portion 314 in a direction perpendicular to the extension direction of the extension portion 313. In this way, when the first inclined surface 311 protrudes outward than the expansion end portion 314, when an external force is applied in the first direction, the first inclined surface 311 may smoothly move along the second inclined surface 321 of the female coupling member 320 without interference from the expansion end portion 314.

Referring to FIGS. 4 and 6, the female coupling member 320 may include a body 322 having a receiving space S to receive at least a portion of the extension portion 313 and the expansion end portion 314 and having a second inclined surface 321 on one side of the inner wall of the receiving space S, and an opening 323 formed in the body 322 in communication with the receiving space S. In this case, the second inclined surface 321 has a shape corresponding to the first inclined surface 311.

The opening 323 may include a first portion 323*a* provided in a shape surrounding the extension 313 and a second portion 323*b* connected to the first part 323*a* and provided in a shape of a slot exposing the second inclined surface 321. More specifically, in an embodiment of the present invention, the first portion 323*a* may be formed in an arch shape, and the second portion 323*b* may be formed in a rectangular shape.

Figure 7:
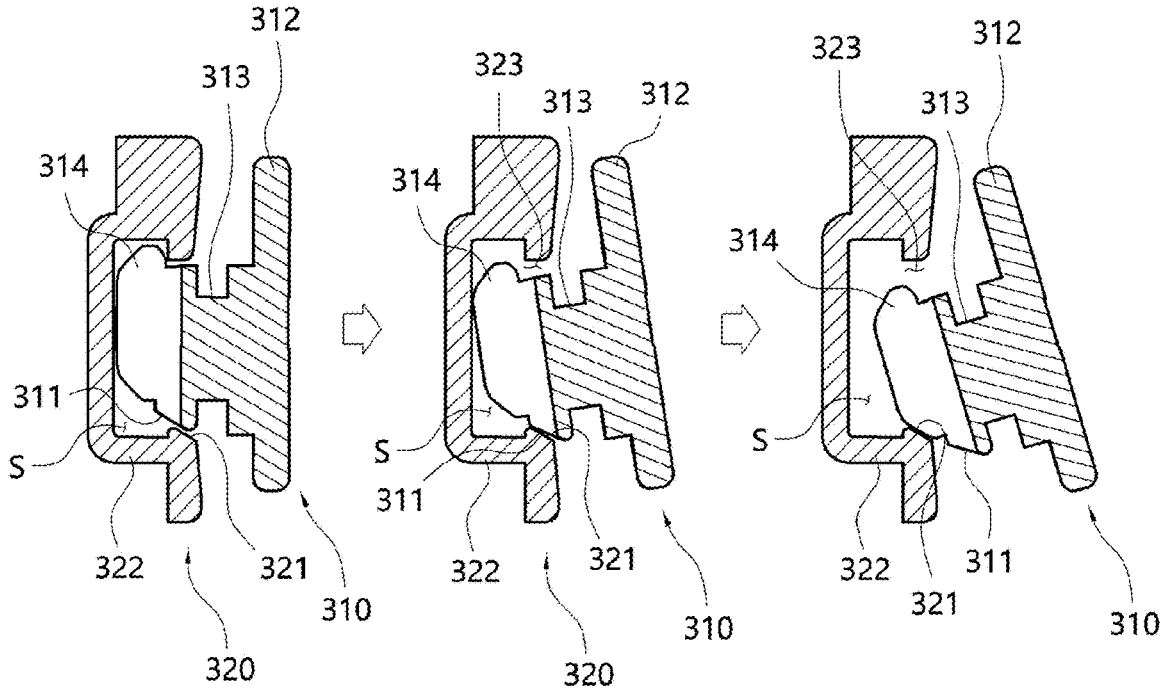
FIG. 7 is a diagram showing a process in which the first inclined surface of the male coupling member of the coupling member of the helmet moves along the second inclined surface of the female coupling member to separate the male coupling member from the female coupling member according to an embodiment of the present invention.
Figure 8:
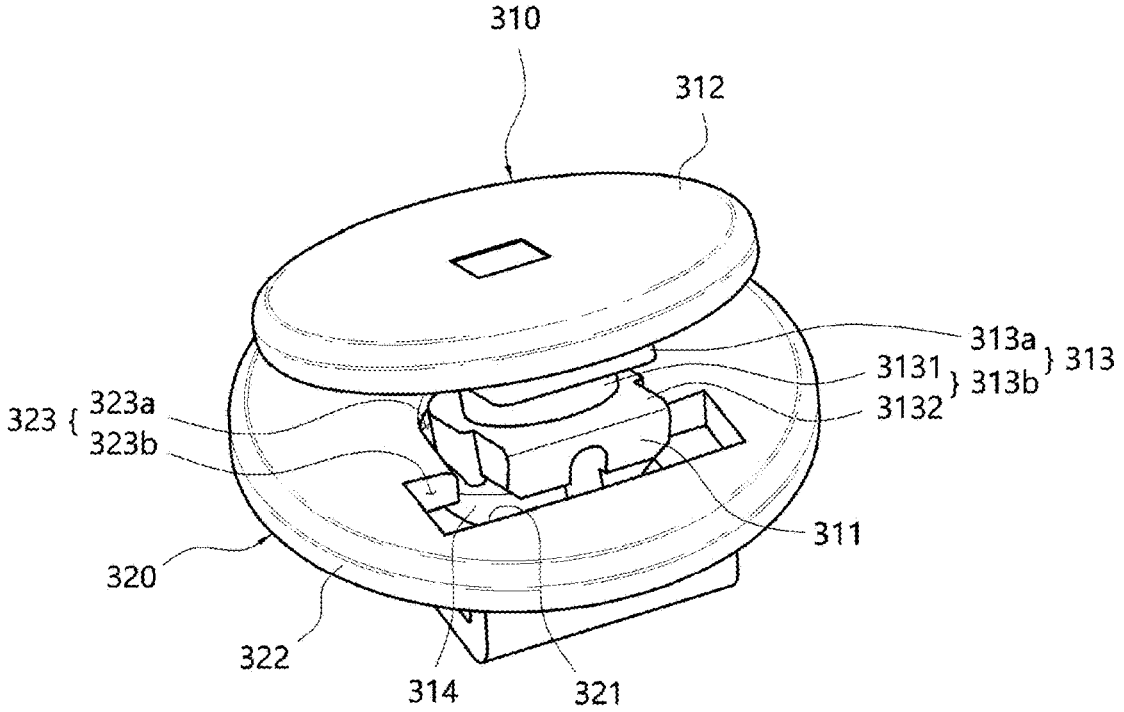
FIG. 8 is a diagram showing a state in which the male coupling member of the coupling member of the helmet is separated from the female coupling member according to an embodiment of the present invention.

FIG. 7 is a diagram showing a process in which the first inclined surface of the male coupling member of the coupling member of the helmet moves along the second inclined surface of the female coupling member to separate the male coupling member from the female coupling member according to an embodiment of the present invention. In addition. FIG. 8 is a diagram showing a state in which the male coupling member of the coupling member of the helmet is separated from the female coupling member according to an embodiment of the present invention. In FIGS. 7 and 8, the illustrations of the helmet body 100, the pad 200, and the cover plate 400 are omitted.

Referring to FIGS. 7 and 8, in a state in which the male coupling member 310 and the female coupling member 320 are fastened in the coupling member 300 of the helmet according to an embodiment of the present invention, the expansion end portion 314 of the male coupling member 310 is fixed in the receiving space S of the female coupling member 320, and the expansion end portion 314 does not pass through the opening 323 of the female coupling member 320 unless the external force is applied in the first direction, that is, the direction in which the first inclined surface 311 can move along the second inclined surface 321. Accordingly, the male coupling member 310 and the female coupling member 320 are maintained in a coupled state, and the pad 200 is stably fixed to the inner surface of the helmet body 100.

When an external force is applied in a state in which the male coupling member 310 and the female coupling member 320 art fastened in a first direction, i.e., a direction in which the first inclined surface 311 may move along the second inclined surface 321, the first inclined surface 311 may move along the second inclined surface 321 and the expansion end portion 314 may exit the receiving space S through the second portion 323*b* of the opening 323 of the female coupling member 320. As a result, the coupling state between the male coupling member 310 and the female coupling member 320 is released, and the pad 200 is separated from the helmet main body 100.

Figure 9:
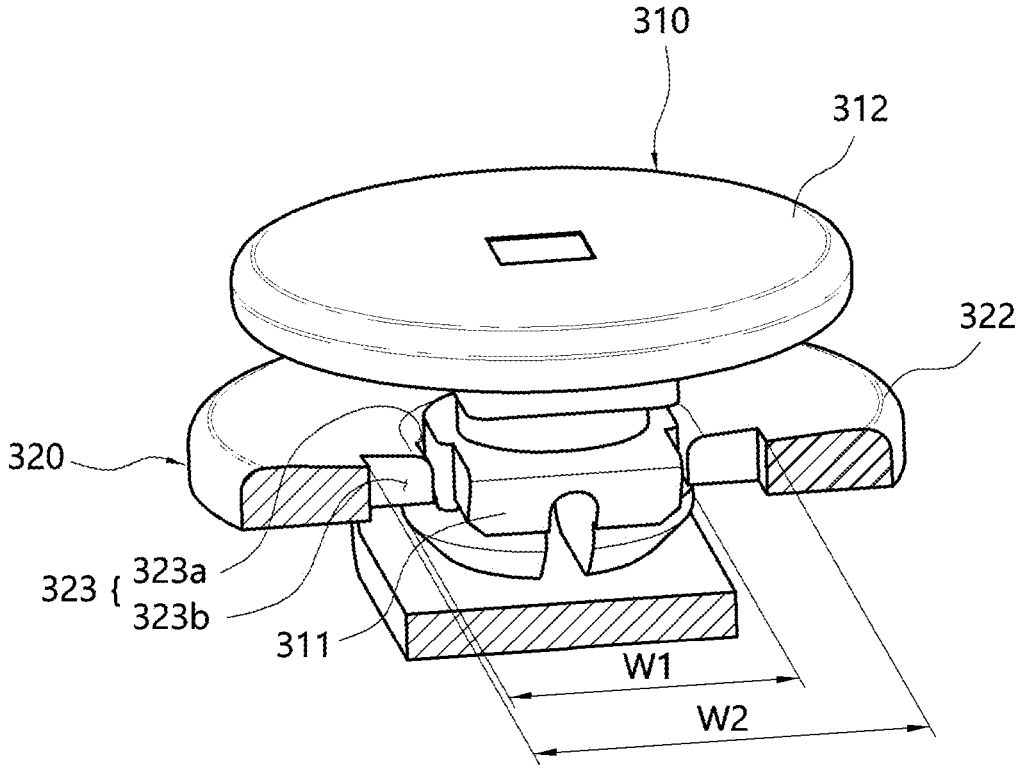
FIG. 9 is a cross-sectional view showing a part of a fastening state between a male coupling member and a female coupling member of a coupling member of a helmet according to an embodiment of the present invention.

In this regard, as shown in FIG. 9, the second inclined surface 321 and the second portion 323*b* may be formed to be wider than the expansion end portion 314. Specifically, the width W2 of the second inclined surface 321 and the second portion 323*b* of the opening 323 is formed to be larger than the width W1 of the expansion end portion 314 of the male coupling member 310. Therefore, when a force is applied in the first direction in the fastened state of the male coupling member 310 and the female coupling member 320, the first inclined surface 311 may move along the second inclined surface 321 and the expansion end portion 314 that has been fixed in the receiving space S may easily escape through the second portion 323*b* of the opening 323.

Meanwhile, when the width W2 of the second inclined surface 321 and the second portion 323*b* of the opening 323 is larger than the width W1 of the expansion end portion 314 of the male coupling member 310, the expansion end portion 314 of the male coupling member 310 is introduced into the receiving space S through the second portion 323*b* of the opening 323 in a state in which the male coupling member 310 and the female coupling member 320 are separated, so that the fastening between the male coupling member 310 and the female coupling member 320 can be easily achieved.

Figure 10:
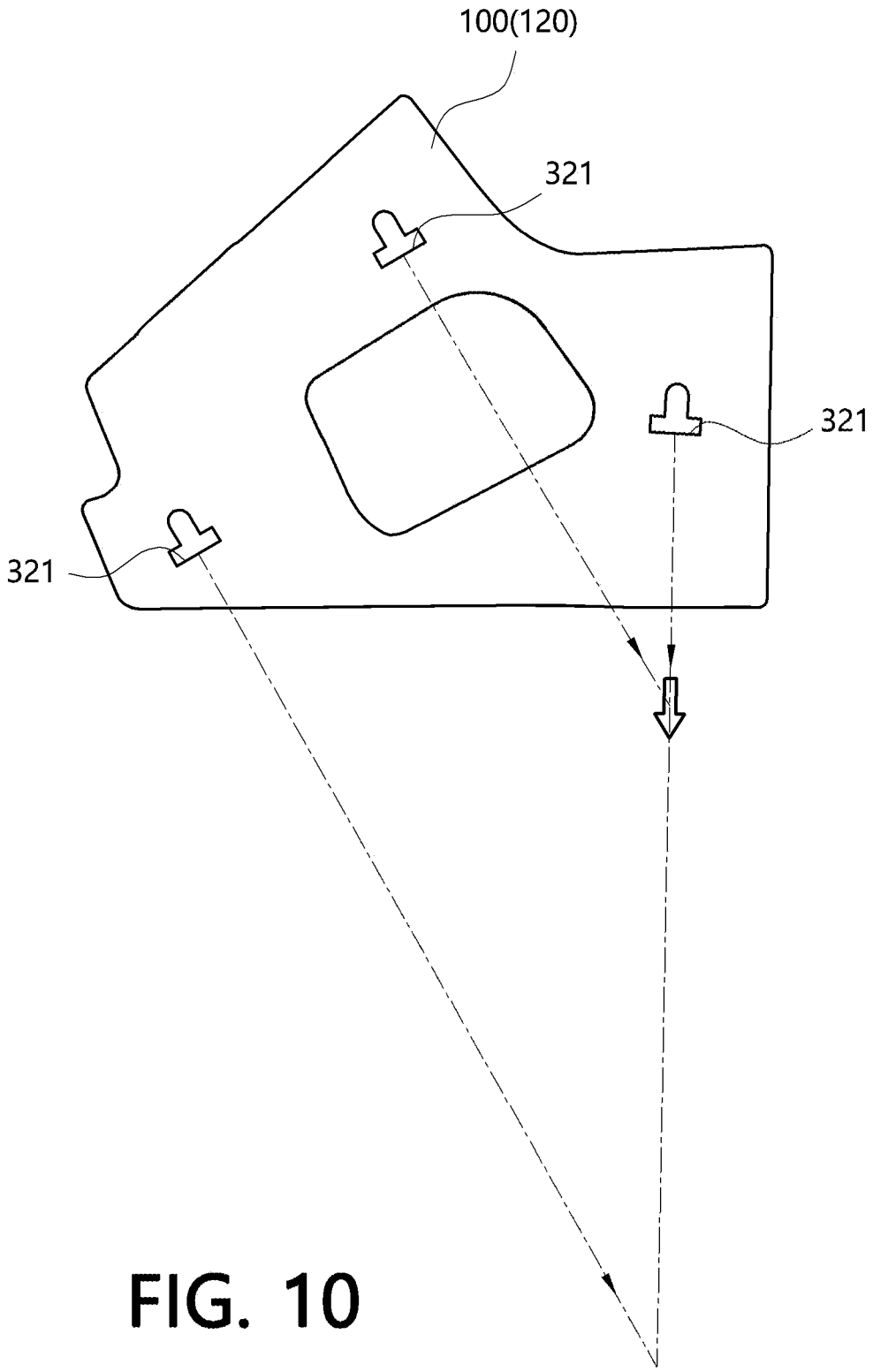
FIG. 10 is a diagram showing the arrangement and orientation of the female coupling member of the coupling member of the helmet according to an embodiment of the present invention.

FIG. 10 is a diagram showing the arrangement and orientation of the female coupling member of the coupling member of the helmet according to an embodiment of the present invention.

In one embodiment of the present invention, pads 200 are disposed on both left and right sides of the inner surface of the helmet body 100, respectively. In addition, a plurality of coupling member 300 are provided on both left and right sides to couple the helmet body 100 and the pad 200. In order to remove the pad 200, it is necessary to release the coupling state between the male coupling member 310 and the female coupling member 320 of each coupling member 300, which means that the first inclined surface 311 of the male coupling member 310 of each coupling member 300 must move along the second inclined surface 321 of the female coupling member 320. Therefore, it is preferable that the first inclined surface 311 and the second inclined surface 321 of each coupling member 300 are oriented so that each of the first inclined surface 311 can move along the second inclined surface 321 by a force in a single direction.

Referring to FIG. 10, it can be confirmed that the second inclined surface 321 of each female coupling member 320 is oriented to face an extension line of an operation point of a force or an operation direction of the force so that a coupling state of a plurality of coupling member 300 can be simultaneously released by the force (displayed by an arrow) acting downward in the drawing. Of course, the first inclined surface 311 of each male coupling member 310 is also disposed to correspond to the orientation of each second inclined surface 321.

Figure 11:
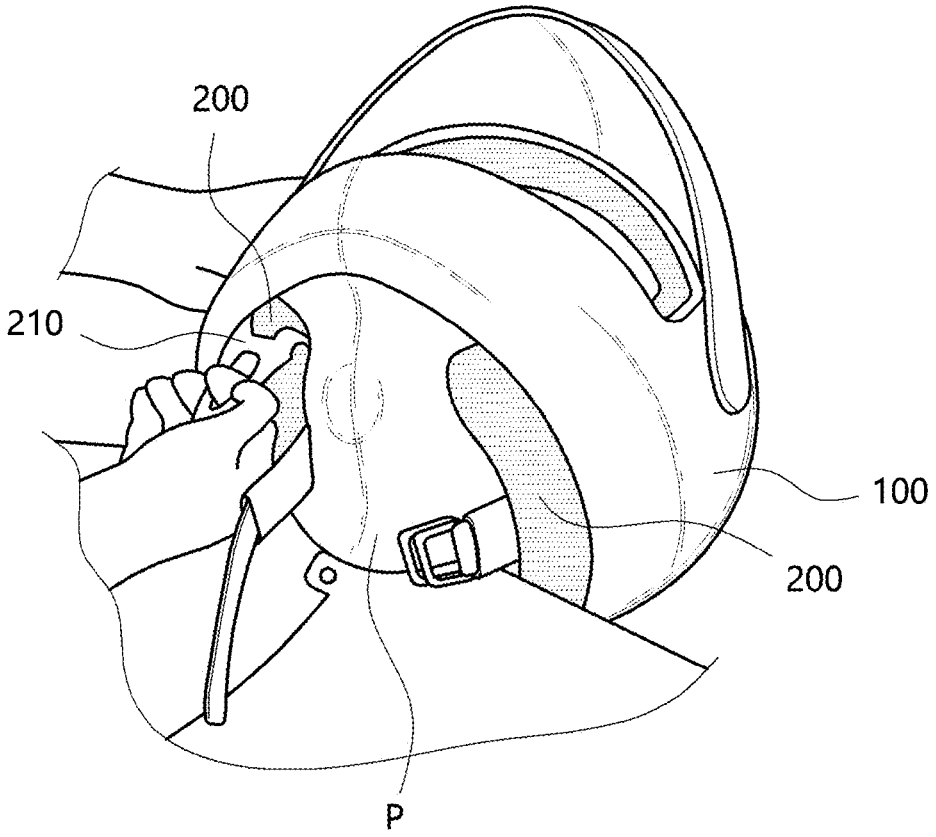
FIG. 11 is a diagram showing a method of removing a pad in a helmet during an emergency according to an embodiment of the present invention.

FIG. 11 is a diagram showing a method of removing a pad in a helmet during an emergency according to an embodiment of the present invention.

Referring to FIG. 11, the helmet according to an embodiment of the present invention may include a pulling portion 210 provided to the pad 200 to be pulled by an external force in a first direction. More specifically, the pulling portion 210 is provided at the lower portion of the pad 200 so that the pad 200 can be pulled from the wearer's head toward the body. Here, the force in the first direction applied to cause the first inclined surface 311 of the male coupling member 310 of each coupling member 300 to move along the second inclined surface 321 of the female coupling member 320 becomes a force acting from the wearer's head toward the body.

In this way, in an embodiment of the present invention, the first inclined surface 311 of the male coupling member 310 and the second inclined surface 321 of the female coupling member 320 may be oriented toward the pulling portion 210 or a virtual point extending in the first direction. Through this, the fastening state of the male coupling member 310 and the female coupling member 320 of the plurality of coupling member 300 can be simultaneously released through one external force. As a result, in an emergency situation, it is possible to easily separate the helmet from the head of the helmet wearer, and to prevent secondary injuries that may occur during the process of severely separating the helmet.

The helmet according to the embodiment of the present invention may be basically applied to a riding helmet for a rider such as a two-wheeled vehicle and a race vehicle.

However, the embodiments of the present invention may be applied to all kinds of helmets including helmets worn during sports games, such as ski, bobbelay, and skeleton, but are not necessarily limited thereto.

Although embodiments of the present disclosure have been described, the spirit of the present disclosure is not limited by the embodiments presented in the specification. Those skilled in the art who understand the spirit of the present disclosure will be able to easily suggest other embodiments by adding, changing, deleting, or adding components within the scope of the same spirit, but this will also be included within the scope of the spirit of the present disclosure.

What is claimed is:

1. A helmet, comprising:

a helmet body;

a pad coupled to an inside of the helmet body; and a coupling member that separably couples the helmet body and the pad, wherein the coupling member comprises:

a male coupling member disposed in one of either the inside of the helmet body or the pad, and a female coupling member disposed in the other of either the inside of the helmet body or the pad and the male coupling member is inserted and fixed into the female coupling member, wherein the male coupling member has a first inclined surface at a portion inserted and fixed into the female coupling member, and the female coupling member has a second inclined surface corresponding to the first inclined surface, and when an external force is applied to the pad in a first direction so that the male coupling member is separated from the female coupling member in a state in which the male coupling member and the female coupling member are coupled, the first inclined surface moves along the second inclined surface, and the pad is separated from the helmet body, wherein the male coupling member comprises:

a base portion fixed to either the inside of the helmet body or the pad;

an extension portion that protrudes and extends from one side of the base portion and has the first inclined surface on one side thereof; and an expansion end portion provided at an end of the extension portion in an extension direction, at least a portion thereof extending outward than the extension portion in a direction perpendicular to the extension direction, wherein the female coupling member comprises:

a body having a receiving space to receive at least a portion of the extension portion and the expansion end portion and having the second inclined surface on one side of an inner wall of the receiving space, and an opening formed in the body in communication with the receiving space, wherein the expansion end portion passes through the second inclined surface and is inserted into the receiving space and is surrounded by the inner wall of the receiving space.

2. The helmet of claim 1, wherein a portion of the extension portion having the first inclined surface protrudes outward than the expansion end portion in a direction perpendicular to the extension direction.

3. The helmet of claim 1, further comprising a cover plate disposed to cover one surface of either the inside of the helmet body or the pad, and fixing the base portion.

4. The helmet of claim 3, wherein the cover plate has a through hole formed in a size that does not pass through the base portion, and wherein the base portion is disposed inside the helmet body or between the pad and the cover plate, and the extension portion extends through the through hole.

5. The helmet of claim 4, wherein the extension portion comprises:

a first extension portion extending through the through hole, and a second extension portion disposed between the first extension portion and the expansion end portion and having the first inclined surface on one side thereof.

6. The helmet of claim 5, further comprising a movement prevention member the movement prevention member comprises:

a fixing portion fixed to the cover plate, and a movement prevention portion connected to the fixing portion to prevent the movement of the male coupling member by being fastened to the extension portion.

7. The helmet of claim 6, wherein the second extension portion comprises a fastening portion to which the movement prevention member is coupled, and the movement prevention portion is coupled to the fastening portion.

8. The helmet of claim 1, wherein the opening comprises:

a first portion provided in a shape surrounding the extension portion and a second portion connected to the first portion and provided in a shape of a slot exposing the second inclined surface.

9. The helmet of claim 8, wherein the second inclined surface and the second portion are formed to be wider than the expansion end portion.

10. The helmet of claim 1, further comprising:

a pulling portion provided to the pad to be pulled by the external force in the first direction, and wherein the first inclined surface and the second inclined surface are oriented toward the pulling portion or a virtual point extending in the first direction.

* * * * *